US008991666B2

(12) United States Patent
Mazyck

(10) Patent No.: US 8,991,666 B2
(45) Date of Patent: Mar. 31, 2015

(54) MULTIPURPOSE CLOTHES HANGER

(76) Inventor: Darren Mazyck, Miramar, FL (US)

( * ) Notice: Subject to any disclaimer, the term of this patent is extended or adjusted under 35 U.S.C. 154(b) by 260 days.

(21) Appl. No.: 13/468,752

(22) Filed: May 10, 2012

(65) Prior Publication Data

US 2013/0299527 A1 Nov. 14, 2013

(51) Int. Cl.

| | |
|---|---|
| ***A41D 27/22*** | (2006.01) |
| ***A47G 25/60*** | (2006.01) |
| ***A47G 25/16*** | (2006.01) |
| ***A47G 25/18*** | (2006.01) |
| ***A47G 25/32*** | (2006.01) |

(52) U.S. Cl.

CPC ..... *A47G 25/60* (2013.01); *A47G 25/16* (2013.01); *A47G 25/183* (2013.01); *A47G 25/32* (2013.01)

USPC ..... 223/85; 223/88

(58) Field of Classification Search

CPC ..... A47G 25/16; A47G 25/18; A47G 25/183; A47G 25/32; A47H 15/02; B65G 2201/0229

USPC ..... 223/85, 86, 88, DIG. 4

See application file for complete search history.

(56) References Cited

U.S. PATENT DOCUMENTS

| | | | | | |
|---|---|---|---|---|---|
| 387,392 | A * | 8/1888 | Braddock | 16/87.8 |
| 1,168,741 | A * | 1/1916 | Potter | 223/86 |
| 1,615,748 | A * | 1/1927 | Fischer | 223/86 |
| 1,981,072 | A * | 11/1934 | Roman et al. | 223/86 |
| 2,187,691 | A * | 1/1940 | Newhouse | 223/86 |
| 2,417,397 | A * | 3/1947 | McCarthy | 223/86 |
| 2,543,810 | A * | 3/1951 | Sklaar | 223/86 |
| 2,864,147 | A * | 12/1958 | Solow | 223/85 |
| 2,878,978 | A * | 3/1959 | Glowka | 223/98 |
| 3,319,850 | A * | 5/1967 | Rosen | 223/92 |
| 3,448,902 | A * | 6/1969 | Stebbins | 223/85 |
| 3,565,261 | A * | 2/1971 | Recla et al. | 223/85 |
| 4,739,912 | A * | 4/1988 | Klawieter et al. | 223/85 |
| 5,558,383 | A * | 9/1996 | Lancellotti | 294/143 |
| 6,206,254 | B1 * | 3/2001 | Lin | 223/94 |
| 7,234,615 | B2 * | 6/2007 | Presser et al. | 223/85 |
| 7,243,822 | B2 * | 7/2007 | Presser et al. | 223/85 |
| 2002/0033403 | A1 * | 3/2002 | Bennett | 223/88 |
| 2005/0230441 | A1 * | 10/2005 | Presser et al. | 223/85 |
| 2005/0242134 | A1 * | 11/2005 | Presser et al. | 223/85 |
| 2009/0078727 | A1 * | 3/2009 | Hassel et al. | 223/88 |
| 2013/0112721 | A1 * | 5/2013 | Presser | 223/85 |

* cited by examiner

*Primary Examiner* — Nathan Durham

(74) *Attorney, Agent, or Firm* — Albert Bordas, P.A.

(57) ABSTRACT

A multipurpose clothes hanger having a frame assembly with a neck and shoulder area. Extending from the neck and shoulder area are first and second lateral sides. The frame assembly further has a bottom side that connects the first and second lateral sides. A hook assembly has first and second bases. Extending from the first and second bases are first and second hooks respectively. The first and second hooks each have at least one cutout. Each at least one cutout has first and second channels extending therefrom. The hook assembly further has a roller assembly and the hook assembly mounts onto the neck area. The roller assembly has a roller, and extending from the roller are first and second pins that extend from the roller in opposite directions. Each at least one cutout receives the roller, and the first and second channels receive the first and second pins respectively.

20 Claims, 7 Drawing Sheets

MULTIPURPOSE CLOTHES HANGER

BACKGROUND OF THE INVENTION

1. Field of the Invention

The present invention relates to hangers for garments, and more particularly, to multipurpose clothes hangers.

2. Description of the Related Art

Applicant is not aware of any clothes hangers suggesting the novel features of the present invention.

SUMMARY OF THE INVENTION

The instant invention is a multipurpose clothes hanger comprising a frame assembly having a neck and shoulder area. Extending from the neck and shoulder area are first and second lateral sides. The frame assembly further comprises a bottom side that connects the first and second lateral sides.

A hook assembly comprises first and second bases. Extending from the first and second bases are first and second hooks respectively. The first and second hooks each comprise at least one cutout. Each at least one cutout comprises first and second channels extending therefrom. The hook assembly further comprises a roller assembly. The hook assembly mounts through the neck area. The roller assembly comprises a roller, and extending from the roller are first and second pins that extend from the roller in opposite directions. Each at least one cutout receives the roller, and the first and second channels receive the first and second pins respectively. The first and second hooks each comprise an interior edge. The roller protrudes a predetermined distance from the interior edges. The neck area comprises a hole to receive the hook assembly. The first and second bases form a circular shape when joined.

The frame assembly further comprises a frame bracket that extends from the neck and shoulder area to the bottom side. The frame bracket is approximately perpendicular to the bottom side and comprises at least one transversal support bracket. The at least one transversal support bracket is approximately parallel to the bottom side and comprises at least one hook member protruding therefrom. The at least one hook member comprises a top face, first and second lateral edges, and a lip that terminates at a top edge.

In a preferred embodiment, the frame assembly comprises first, second, and third transversal support brackets that are approximately parallel to the bottom side. The first, second, and third transversal support brackets each comprise at least one hook member protruding therefrom, and each at least one hook member comprises a top face, first and second lateral edges, and a lip that terminates at a top edge. The frame bracket may also comprise a basket to contain chemical pesticides and/or deodorants, such as mothballs, for garments and/or clothing susceptible to damage from mold or moth larvae.

It is therefore one of the main objects of the present invention to provide a multipurpose clothes hanger for storing multiple garments and/or clothing on respective hangers.

It is another object of this invention to provide a multipurpose clothes hanger that comprises chemical pesticides and/or deodorants for garments and/or clothing susceptible to damage from mold or moth larvae.

It is another object of this invention to provide a multipurpose clothes hanger that is of a durable and reliable construction.

It is yet another object of this invention to provide such a device that is inexpensive to manufacture.

It is yet another object of this invention to provide such a device that is effective to maintain.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
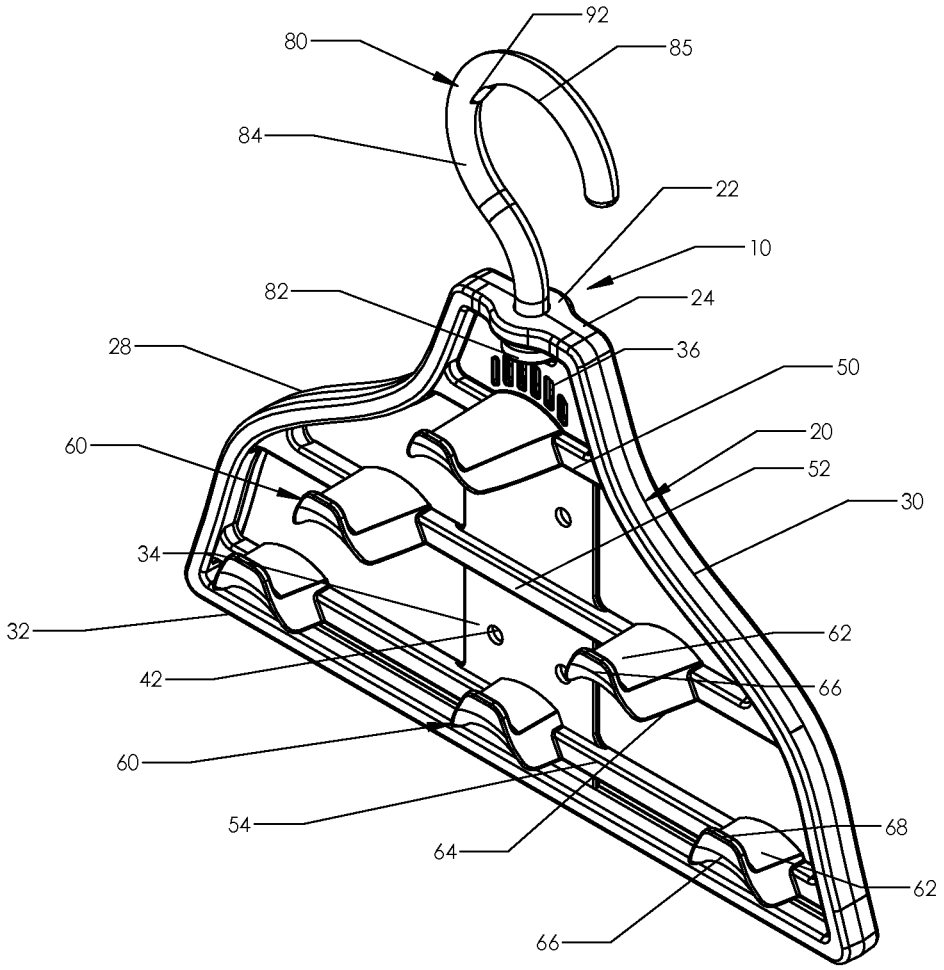
FIG. 1 is a front isometric view of the present invention.

Referring now to the drawings, the present invention is a multipurpose clothes hanger and is generally referred to with numeral 10. It can be observed that it basically includes frame assembly 20 and hook assembly 80.

Figure 2:
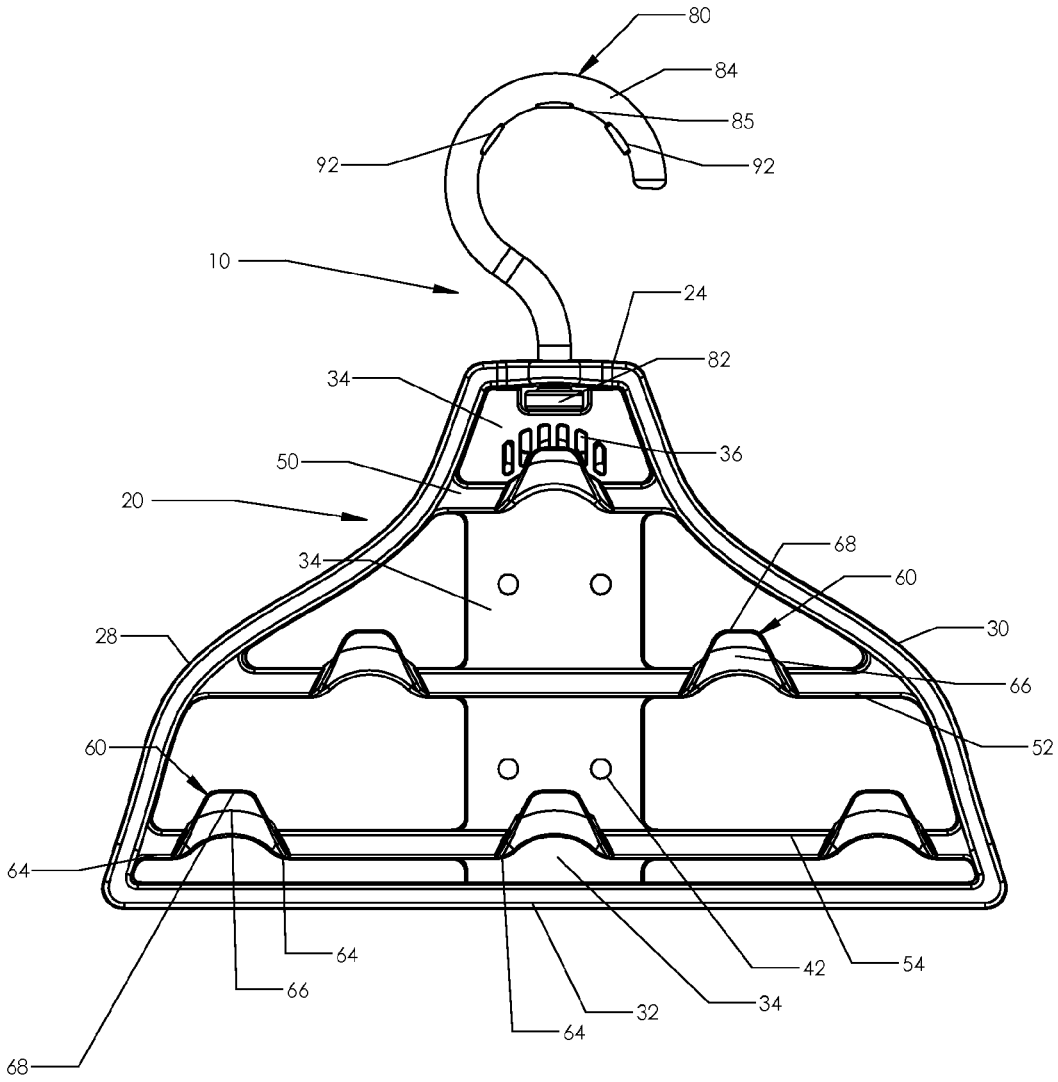
FIG. 2 is a front elevation view of the present invention.

As seen in FIGS. 1 and 2, frame assembly 20 comprises neck area 22 and shoulder area 24. Extending from neck area 22 and shoulder area 24 are first and second lateral sides 28 and 30. Frame assembly 20 further comprises bottom side 32 that connects first and second lateral sides 28 and 30. Frame assembly 20 further comprises frame bracket 34. Frame bracket 34 may comprise holes 42 and extends from neck area 22 and shoulder area 24 to bottom side 32. Frame bracket 34 is approximately perpendicular to bottom side 32.

Frame assembly 20 further comprises at least one transversal support bracket 50. However, in a preferred embodiment, frame assembly 20 comprises first, second, and third transversal support brackets 50; 52; and 54 respectively. First, second, and third transversal support brackets 50; 52; and 54 are approximately parallel to bottom side 32 and comprise at least one hook member 60 protruding therefrom. In the illustrated embodiment, transversal support bracket 50 is a first predetermined distance from bottom side 32 and comprises one hook member 60; transversal support bracket 52 is a second predetermined distance from bottom side 32 and comprises two hook members 60; and transversal support bracket 54 is a third predetermined distance from bottom side 32 and comprises three hook members 60, whereby the hook member 60 of transversal support bracket 50 is vertically aligned with the center hook member 60 of transversal support bracket 54. Each at least one hook member 60 comprises top face 62, first and second lateral edges 64, and lip 66 that terminates at top edge 68.

Figure 3:
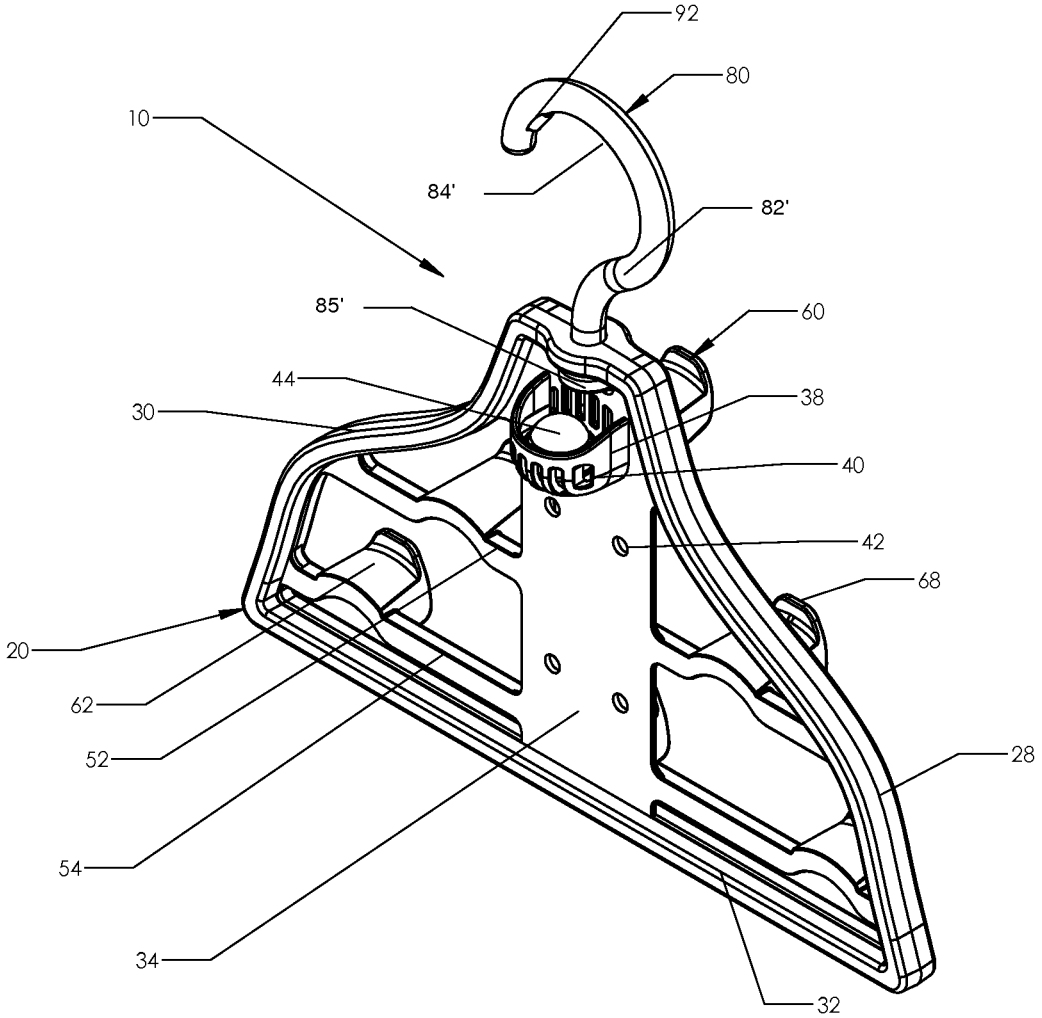
FIG. 3 is a rear isometric view of the present invention.
Figure 4:
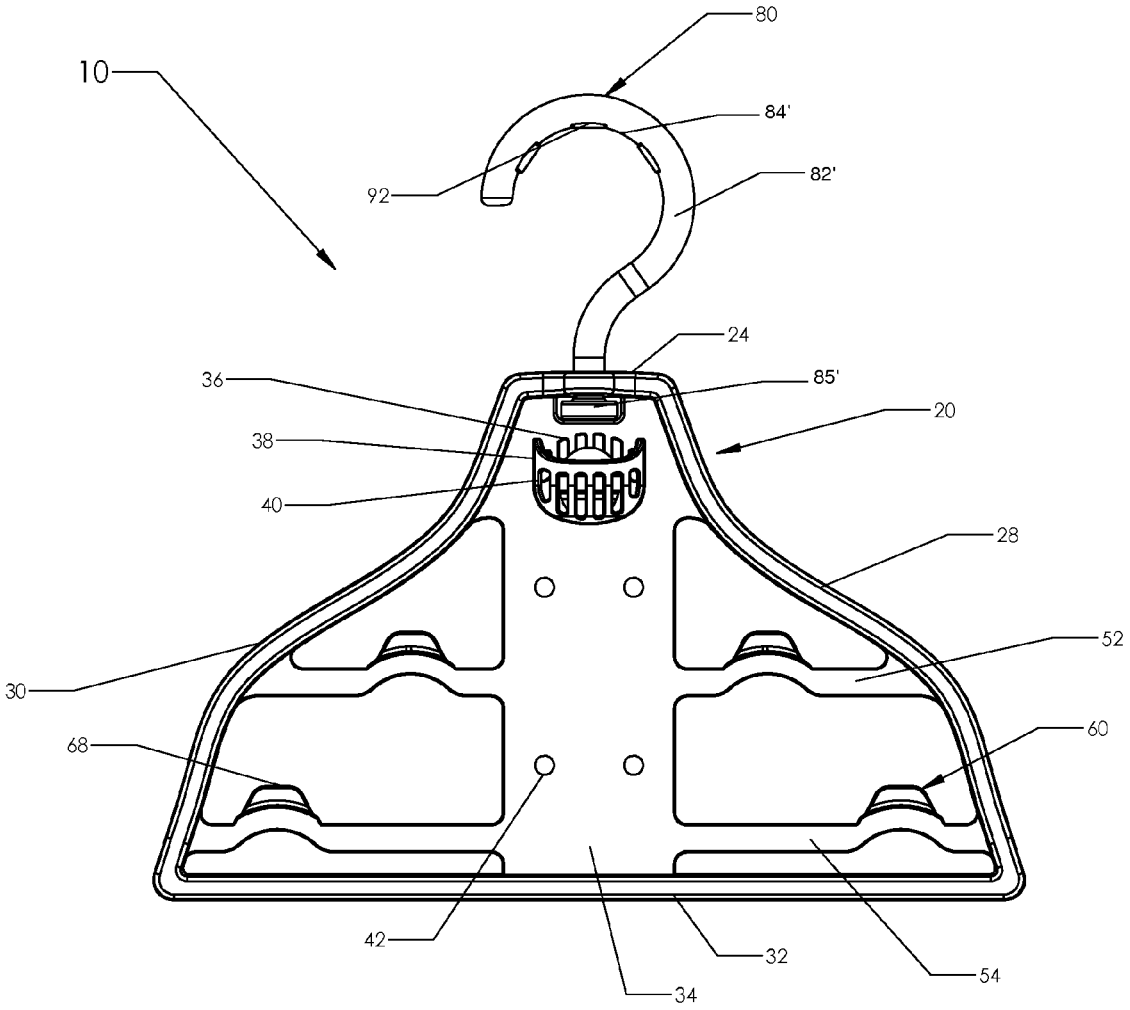
FIG. 4 is a rear elevation view of the present invention.

As seen in FIGS. 3 and 4, frame bracket 34 comprises basket 38 designed to contain chemical pesticides and/or deodorants, such as mothball 44, for garments and/or clothing susceptible to damage from mold or moth larvae. Frame bracket 34 may comprise holes 36 and basket 38 may contain holes 40 to promote better efficiency of mothball 44 with better circulation of the chemical pesticides and/or deodorants.

Figure 5:
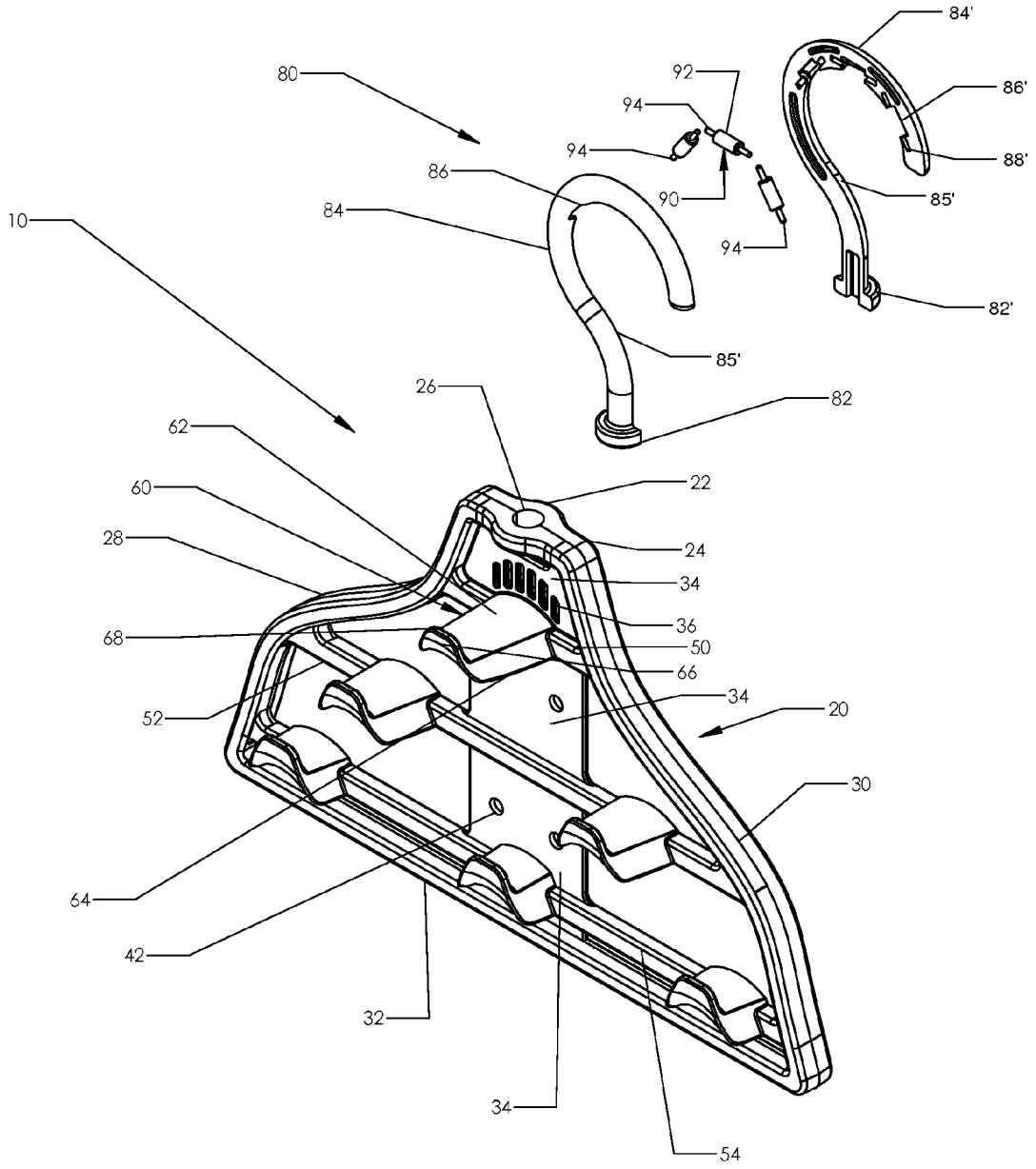
FIG. 5 is a front exploded view of the present invention.

As seen in FIG. 5, hook assembly 80 comprises first and second bases 82 and 82'. Extending from first and second bases 82 and 82' are first and second hooks 84 and 84' respectively. First and second hooks 84 and 84' comprise at least one cutout 86 and 86' respectively. Each at least one cutout comprises first and second channels extending therefrom, although only channel 88' is seen in this illustration. Hook assembly 80 further comprises at least one roller assembly 90. Each roller assembly 90 comprises roller 92, extending from roller 92 are first and second pins 94 that extend from roller 92 in opposite directions. Each at least one cutout receives roller 92; and the first and second channels receive first and second pins 94 respectively.

First and second hooks 84 and 84' comprise interior edges 85 and 85' respectively. As best seen in FIGS. 2 and 4, rollers 92 protrude a predetermined distance from interior edges 85 and 85' to allow rollers 92 to ride upon a bar or pole on which instant invention is hung on, not seen. Hook assembly 80 mounts through neck area 22, whereby neck area 22 comprises hole 26. First and second bases 82 and 82' form a circular shape when joined.

Figure 6:
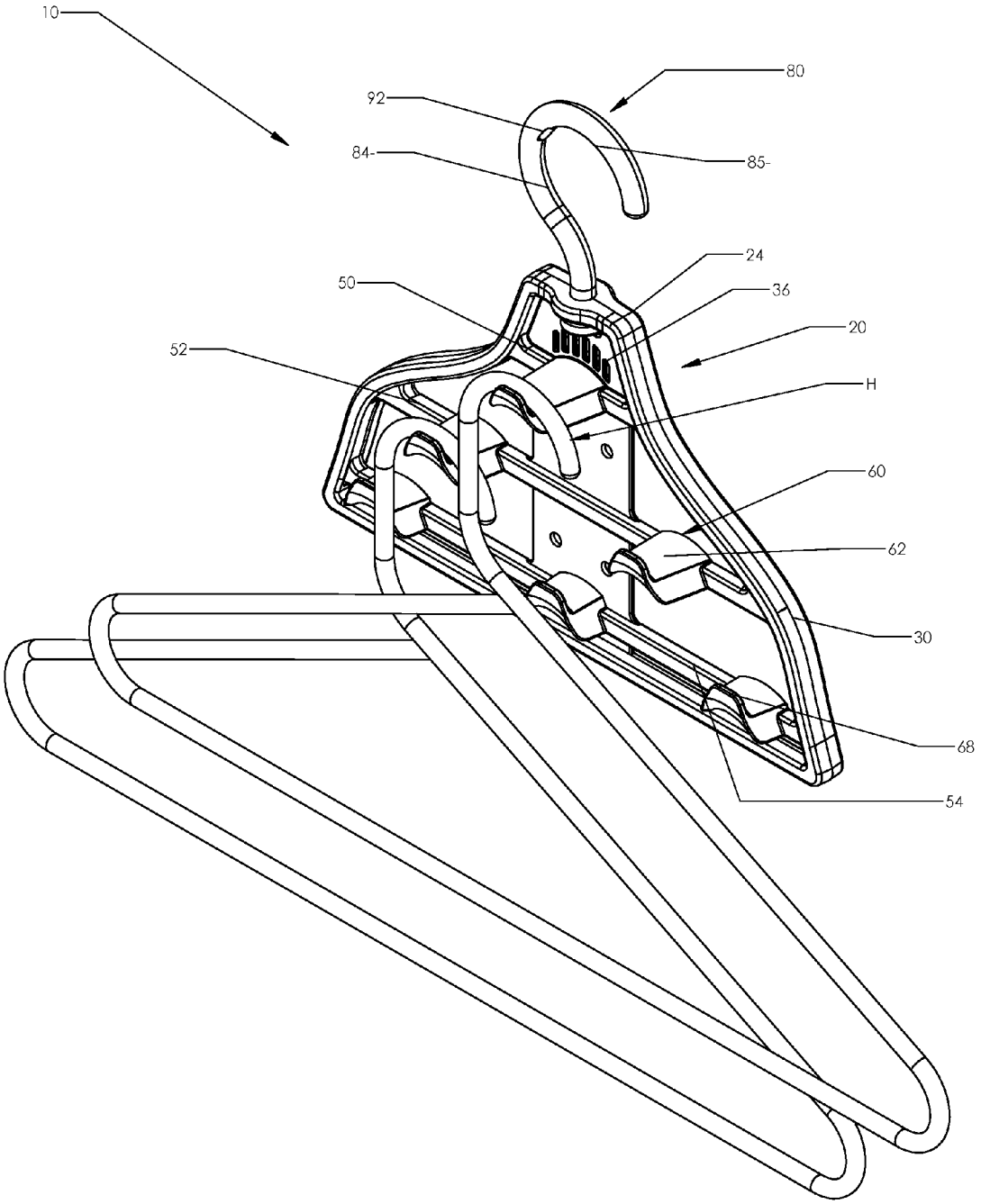
FIG. 6 is a front isometric view of the present invention with hangers suspended thereon.

As seen in FIG. 6, each at least one hook member 60 comprises top face 62, first and second lateral edges 64, and lip 66 that terminates at top edge 68; designed to effectively receive a hanger H thereon, and specifically a hook of hanger H. In a preferred embodiment, instant invention 10 may have at least one hanger H suspended one each hook member 60.

Figure 7:
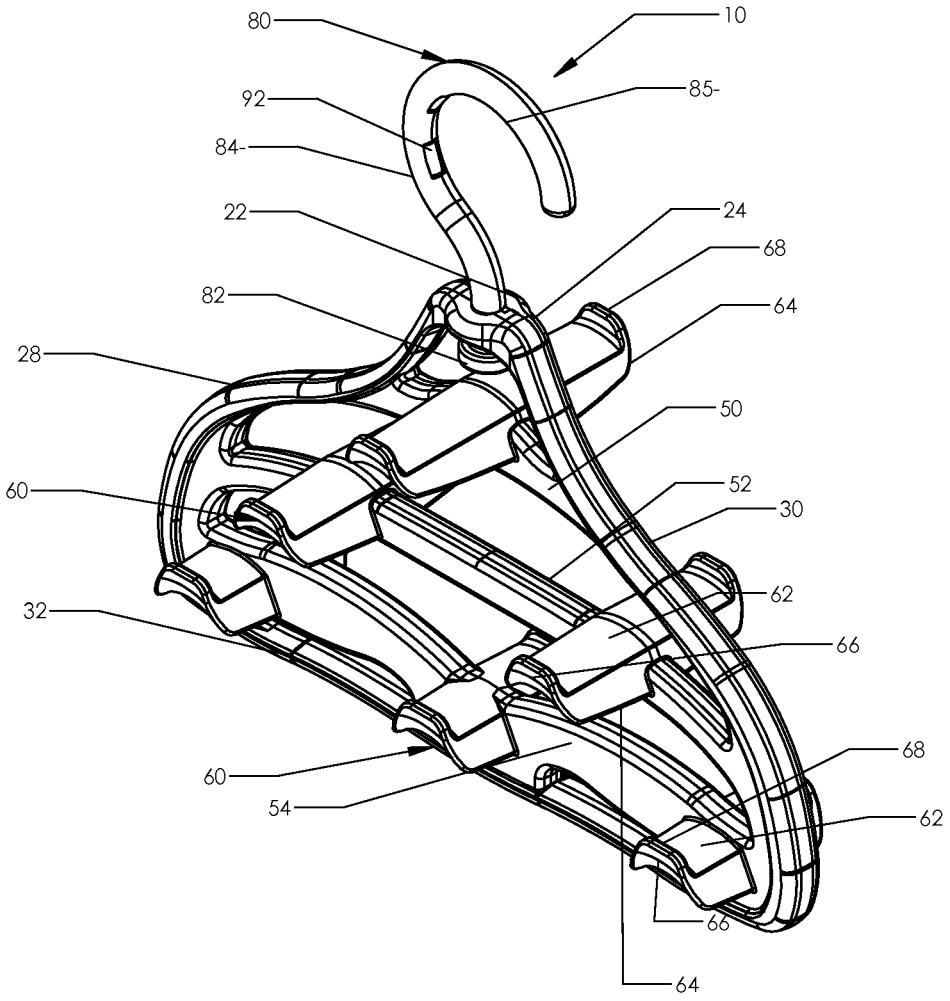
FIG. 7 is a front isometric view of an alternate embodiment of the present invention.

As seen in FIG. 7, an alternate embodiment of instant invention 10 includes each side of transversal support bracket 50 comprising one hook member 60; each side of transversal support bracket 52 comprising two hook members 60; and each side of transversal support bracket 54 comprising three hook members 60. Each hook member 60 comprises top face 62, first and second lateral edges 64, and lip 66 that terminates at top edge 68.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A multipurpose clothes hanger comprising:

A) a frame assembly comprising a neck and shoulder area, extending from said neck and shoulder area are first and second lateral sides, said frame assembly further comprising a bottom side connecting said first and second lateral sides; and B) a hook assembly comprising first and second bases that form a circular shape when joined and mounted to said neck area, whereby said first and second bases trespass said frame assembly and are exposed, a first diameter defined by said first and second bases is larger than a second diameter defined by a shaft of said hook assembly, extending from said first and second bases are first and second hooks respectively, said first and second hooks each comprise at least two cutouts, each said at least two cutouts comprising first and second channels extending therefrom, said hook assembly further comprising at least two roller assemblies for respective said at least two cutouts, each of said at least two roller assemblies comprise a roller, extending linearly from said roller in opposite directions are first and second pins, each of said at least two cutouts receives one of said at least two roller assemblies respectively, whereby said first and second channels receive said first and second pins respectively.

2. The multipurpose clothes hanger set forth in claim 1, further characterized in that said first and second hooks each comprise an interior edge, each said roller protrudes a predetermined distance from said interior edges.

3. The multipurpose clothes hanger set forth in claim 1, further characterized in that said neck area comprises a hole to receive said hook assembly.

4. The multipurpose clothes hanger set forth in claim 1, further characterized in that said frame assembly further comprises a frame bracket.

5. The multipurpose clothes hanger set forth in claim 4, further characterized in that said frame bracket extends from said neck and shoulder area to said bottom side.

6. The multipurpose clothes hanger set forth in claim 4, further characterized in that said frame bracket is approximately perpendicular to said bottom side.

7. The multipurpose clothes hanger set forth in claim 4, further characterized in that said frame bracket comprises a basket.

8. The multipurpose clothes hanger set forth in claim 1, further characterized in that said frame assembly further comprises at least one transversal support bracket.

9. The multipurpose clothes hanger set forth in claim 8, further characterized in that said at least one transversal support bracket is approximately parallel to said bottom side.

10. The multipurpose clothes hanger set forth in claim 8, further characterized in that each said at least one transversal support bracket comprises at least one hook member protruding therefrom.

11. The multipurpose clothes hanger set forth in claim 10, further characterized in that each said at least one hook member comprises a top face, first and second lateral edges, and a lip that terminates at a top edge.

12. The multipurpose clothes hanger set forth in claim 1, further characterized in that said frame assembly further comprises first, second, and third transversal support brackets.

13. The multipurpose clothes hanger set forth in claim 12, further characterized in that said first, second, and third transversal support brackets are approximately parallel to said bottom side.

14. The multipurpose clothes hanger set forth in claim 12, further characterized in that each said first, second, and third transversal support brackets comprise at least one hook member protruding therefrom.

15. The multipurpose clothes hanger set forth in claim 14, further characterized in that each said at least one hook member comprises a top face, first and second lateral edges, and a lip that terminates at a top edge.

16. A multipurpose clothes hanger comprising:

A) a frame assembly comprising a neck and shoulder area, extending from said neck and shoulder area are first and second lateral sides, said frame assembly further comprising a bottom side connecting said first and second lateral sides; and B) a hook assembly comprising first and second bases that form a circular shape when joined and mounted to said neck area, whereby said first and second bases trespass said frame assembly and are exposed, a first diameter defined by said first and second bases is larger than a second diameter defined by a shaft of said hook assembly, extending from said first and second bases are first and second hooks respectively, said first and second hooks each comprise at least two cutouts, each said at least two cutouts comprising first and second channels extending therefrom, said hook assembly further comprising at least two roller assemblies for respective said at least two cutouts, each of said at least two roller assemblies comprise a roller, extending linearly from said roller in opposite directions are first and second pins, each of said at least two cutouts receives one of said at least two roller assemblies respectively, whereby said first and second channels receive said first and second pins respectively, said first and second hooks each comprise an interior edge, each said roller protrudes a predetermined distance from said interior edges.

17. The multipurpose clothes hanger set forth in claim 16, further characterized in that said neck area comprises a hole to receive said hook assembly.

18. The multipurpose clothes hanger set forth in claim 17, further characterized in that said frame assembly further comprises a frame bracket.

19. The multipurpose clothes hanger set forth in claim 18, further characterized in that said frame bracket extends from said neck and shoulder area to said bottom side.

20. The multipurpose clothes hanger set forth in claim 19, further characterized in that said frame bracket is approximately perpendicular to said bottom side.

* * * * *